US006234746B1

(12) United States Patent
Schroder et al.

(10) Patent No.: US 6,234,746 B1
(45) Date of Patent: May 22, 2001

(54) APPARATUS AND METHODS FOR COOLING ROTARY COMPONENTS IN A TURBINE

(75) Inventors: Mark Stewart Schroder, Hendersonville, NC (US); Jeffrey John Butkiewicz, Simpsonville, SC (US)

(73) Assignee: General Electric Co., Schenectady, NY (US)

( * ) Notice: Subject to any disclaimer, the term of this patent is extended or adjusted under 35 U.S.C. 154(b) by 0 days.

(21) Appl. No.: 09/368,121

(22) Filed: Aug. 4, 1999

(51) Int. Cl.[7] ..... F01D 5/08

(52) U.S. Cl. ..... 415/115; 415/116; 415/117; 415/110; 415/113; 415/176; 415/178; 415/180; 416/95; 416/96 R; 416/97 R; 416/198 A; 416/201 R; 60/39.75

(58) Field of Search ..... 415/110–112, 115–117, 415/168.4, 175–178, 180; 416/95, 96 R, 94 A, 97 R, 198 A, 201 R; 60/39.07, 39.75

(56) References Cited

U.S. PATENT DOCUMENTS 3,565,545 * 2/1971 Bobo et al. ..... 415/175
3,826,084 * 7/1974 Branstrom et al. ..... 415/115
4,882,902 * 11/1989 Reigel et al. ..... 60/39.75
5,189,874 * 3/1993 Kreitmeier ..... 60/39.75

FOREIGN PATENT DOCUMENTS

2018362 * 10/1979 (GB) ..... 60/39.75

* cited by examiner

*Primary Examiner*—Christopher Verdier
(74) *Attorney, Agent, or Firm*—Nixon & Vanderhye

(57) ABSTRACT

A cooling system for turbomachinery includes a compressor bleed air passageway for supplying bleed cooling air to a plurality of circumferentially spaced, generally axially extending passages in communication with a cavity within the inner barrel in which the flanges of the turbine and compressor rotors are secured to one another. The exit ends of the passages have swirl devices for turning the flow from the general axial direction to a tangential direction corresponding to the direction of rotation of the combined rotors. A leakage seal is provided between the rotor and the stationary component to provide a pressure drop across a plenum and cavity to increase the velocity of air flowing into the cavity. Consequently, cooling air is supplied the cavity at a tangential velocity approaching the rotor velocity with reduced windage and lower temperature, thereby improving the performance of the turbomachinery.

7 Claims, 3 Drawing Sheets

APPARATUS AND METHODS FOR COOLING ROTARY COMPONENTS IN A TURBINE

BACKGROUND OF THE INVENTION

The present invention relates to a cooling system for cooling rotary components of a turbine and particularly relates to a cooling system for imparting cooling flow in the same general circumferential direction of the rotary component to be cooled.

In turbomachinery, for example, a turbine and compressor combination, various rotating parts of the machinery must be cooled. To accomplish this, compressor discharge air is typically bled from the compressor. Continued demand for increased machine performance has resulted in increasing coolant supply temperatures and reduced bleed or parasitic flow allocated for cooling hardware. That is, machine performance degrades as increasing proportions of compressor discharge air are applied for cooling purposes. A particular problem arises in cooling rotating parts, for example, the flange connection between the compressor and turbine rotor. As a result of increased heat applied to the cooling medium in reaching the surface velocity of the rotating component, reduced cooling effect occurs and the requirement for parasitic cooling flow increases. Accordingly, there is a demonstrable need for a turbomachinery cooling system wherein the work necessary to cool the rotating components is substantially reduced, resulting in decreased parasitic cooling flow.

BRIEF SUMMARY OF THE INVENTION

In accordance with a preferred embodiment of the present invention, air is bled from the compressor discharge and supplied to a plurality of generally axially extending bleed air passages. The passages, for example, may lie within the inner barrel on the compressor side of the flange connections between the turbine and compressor rotors. Preferably, the bleed air is supplied to a plenum on the upstream side of the passages such that the passages flow the compressor discharge bleed air into a downstream cavity surrounding the rotor flanges. The generally axially flowing bleed compressor discharge air in the passages is turned in a generally circumferential direction, i.e., generally tangential to the direction of rotation of the rotary component, e.g., the rotor flanges. The air is turned by locating one or more vanes at the exit of the passages for flowing cooling air into the cavity in a generally tangential direction and in the same direction of rotation of the rotary component. By injecting the cooling air tangentially with rotation, minimal work is performed by the turbomachinery in flowing the cooling air tangentially of the rotating component, thereby affording a lower cooling temperature. The lower temperature results from less windage heat up of the cooling air in approaching the tangential surface velocity of the rotating component. Reduced windage also provides a performance benefit and less transfer of work from the rotor to the coolant.

Leakage flow from the bleed air plenum between the stationary component surrounding the rotary component is provided through a leakage seal. The seal may be in the form of a labyrinth seal, brush seal, combination labyrinth or brush seals or other types of seals. The leakage seal provides a pressure differential across the bleed air supply plenum and the cavity, affording increased velocity of the cooling air flowing from the vanes into the cavity in the general direction of rotation of the rotary component. Consequently, by providing as effective a leakage seal as possible, a lower coolant temperature is achieved with corresponding reduction in the magnitude of the parasitic flow extracted from the compressor discharge flow path necessary for cooling purposes.

In a preferred embodiment according to the present invention, there is provided in turbomachinery having a turbine, a compressor, a component rotatable about an axis and in a cavity, and a fixed component about the rotatable component and the cavity, a cooling system, comprising a bleed air passageway for diverting a portion of compressor discharge air for cooling the rotating component, a plurality of discrete, generally axially extending passages in communication with the bleed passageway for flowing the bleed air into the cavity and vanes in the passages for turning the bleed air flowing into the cavity in a generally circumferential direction and in the general direction of rotation of the rotatable component to cool the rotatable component.

In a further preferred embodiment according to the present invention, there is provided in turbomachinery having a turbine, a compressor, a component rotatable about an axis, and a fixed component about the rotatable component, a method of cooling the rotatable component, comprising the steps of bleeding compressor discharge air into a passageway, flowing portions of the bleed air into a plurality of generally axially extending passages in communication with the air portion bled from the compressor discharge air and turning the bleed air portions flowing in the passages in a generally circumferential direction for discharge onto the rotatable component and in the same general direction as the rotation of the rotary component to cool the rotary component.

DETAILED DESCRIPTION OF THE INVENTION

Figure 1:
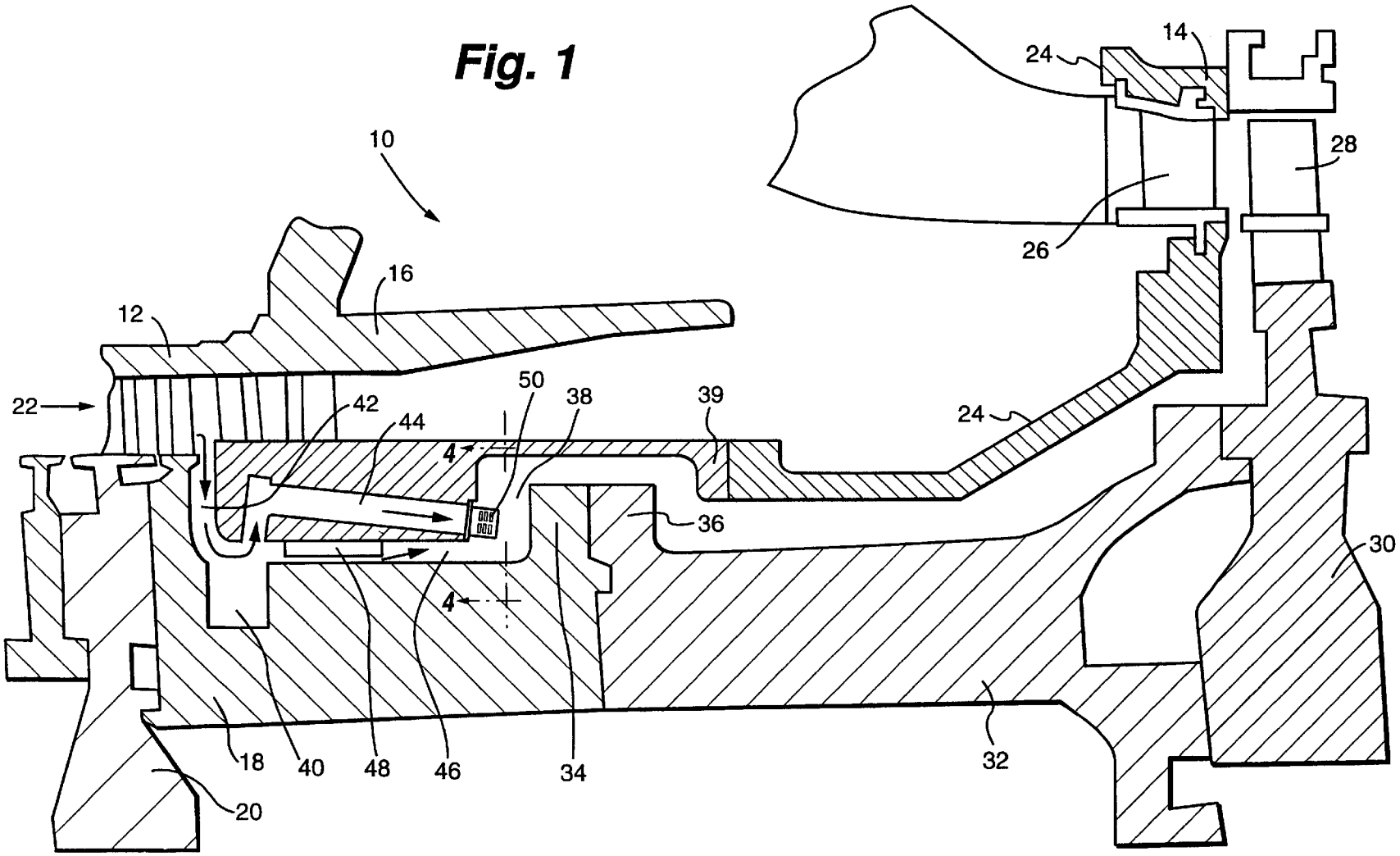
FIG. 1 is a fragmentary cross-sectional view of a turbomachine illustrating a cooling system according to a preferred embodiment of the present invention.

Referring now to the drawing figures, particularly to FIG. 1, there is illustrated a turbomachine, generally designated 10, and incorporating a cooling system according to a preferred embodiment of the present invention. The turbomachine 10 includes a compressor section 12 and a turbine section 14. The compressor section 12 comprises an outer fixed or stationary component 16 and a rotor 18 joined to compressor wheels 20 mounting compressor blades. It will be appreciated that air is compressed along an annular flow path, designated by the arrow 22, and flows into the turbine section 14.

Turbine section 14 includes a fixed or stationary component 24 and a plurality of turbine stages, each including a stator blade 26 and a turbine blade 28 rotatable on a turbine wheel 30 forming part of the turbine rotor 32. The adjoining ends of the compressor rotor 18 and turbine rotor 32 carry flanges 34 and 36, respectively, which are rabbeted and bolted to one another by bolts, not shown and form a rotary component within a cavity 38 surrounded by a fixed component, e.g., an inner barrel 39.

In accordance with a preferred embodiment of the present invention, a cooling system is provided for metering desired bypass flow mixed with seal leakage for cooling the flange connection of the rotors, efficiently turning the flow from axial to a desired circumferential direction to lower the temperature of the cooling flow for rotor conditioning and directing the flow at an optimum location within the flange cavity 38 for mixing with seal leakage and conditioning the flange. Particularly, bleed air is taken from the compressor discharge air flowing in annular passage 22 for flow into an annular plenum 40 in the compressor rotor 18. One or more of the bleed air passageways 42 may be provided for supplying plenum 40 with bleed air. A plurality of discrete, generally axially extending passages 44 is provided at circumferentially spaced positions about the compressor rotor 18 for flowing compressor bleed air from the plenum 40 into the cavity 38. Additionally, an annular leakage flow path 46 between the stationary component and the compressor rotor 18 is provided with a leakage seal 48. For example, the leakage seal may comprise a plurality of labyrinth seals or brush seals or a combination of labyrinth/brush seals or other types of seals. Suffice to say that the annular leakage flow path 46 with the leakage seal 48 creates a pressure drop between the plenum 40 and the cavity 38.

Figure 3:
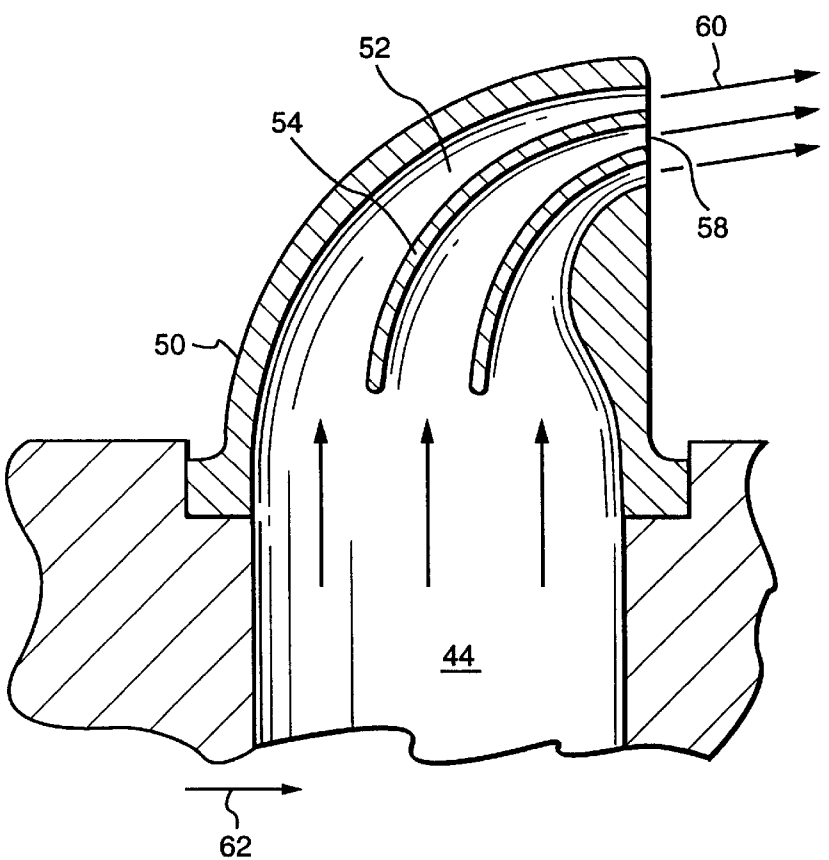
FIG. 3 is a cross-sectional view thereof taken generally about on line 3—3 in FIG. 2.
Figure 2:
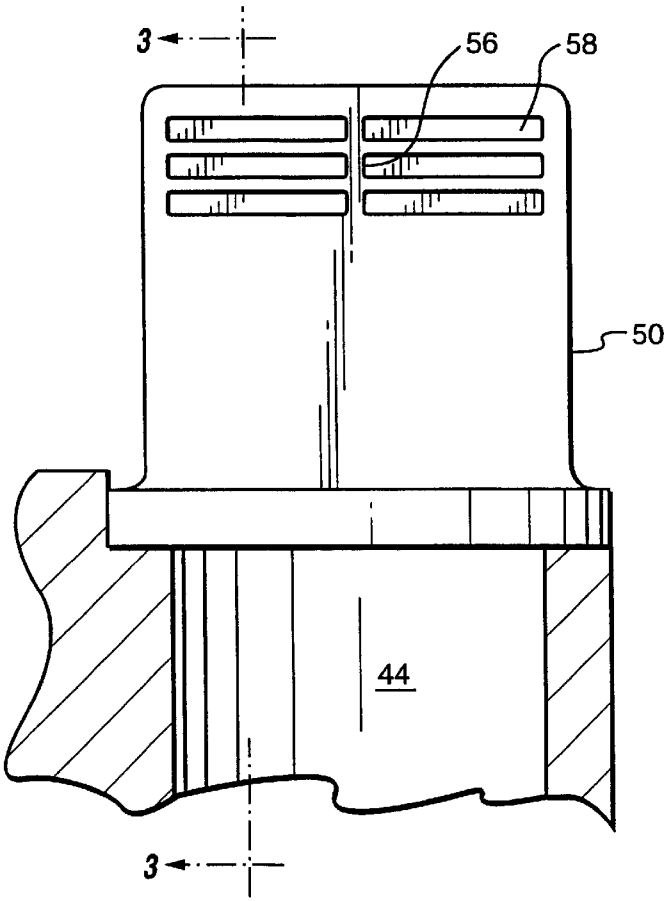
FIG. 2 is an enlarged fragmentary cross-sectional view illustrating a nozzle for the cooling air.
Figure 4:
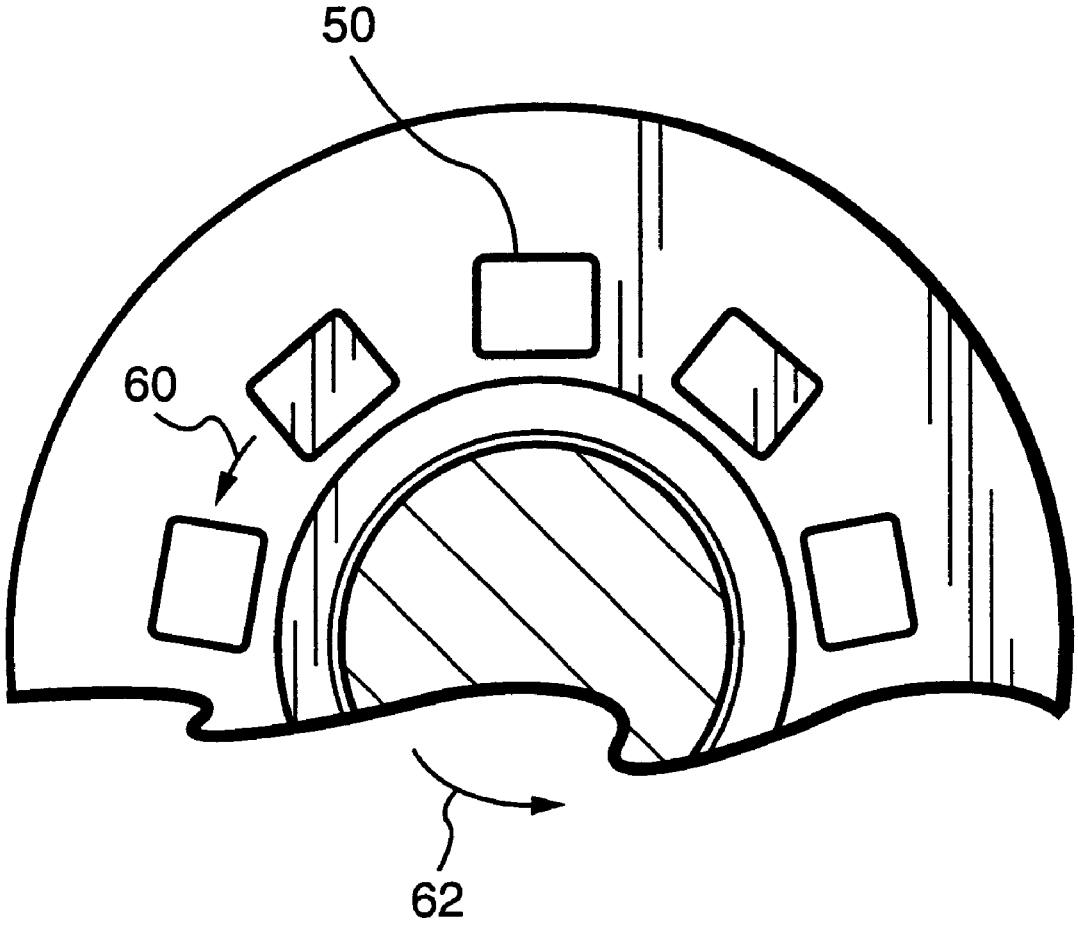
FIG. 4 is a fragmentary cross-sectional view taken generally about line 4—4 in FIG. 1.

Each of the exit ends of the passages 44 includes one or more vanes comprising a swirl device 50. As illustrated in FIGS. 2 and 3, the device 50 has a plurality of internal flow paths 52 defined by vanes 54 for turning the bleed air flowing in passage 44 toward a tangential or circumferential direction of rotation of the flanges in cavity 38. That is, the bleed air flowing through each passage 44 is turned into a generally tangential direction in the direction of rotation of the flanges 34 and 36 whereby the bleed air flowing from swirl devices 50 exits at a velocity approaching the tangential velocity of the flanges 34 and 36. A central rib 56 is provided between the generally rectilinear slots 58 forming exits for the bleed discharge air being turned along the flow paths 52. The direction of the exiting air is indicated by the arrows 60 in FIG. 4 and the direction of rotation of the compressor rotor 18 is indicated by the arrow 62. Consequently, it will be appreciated that the compressor bleed discharge air exits the swirl devices at a substantially lower temperature than would otherwise be the case if the air was flowing directly axially into the cavity 38. Moreover, the compressor discharge bleed air does not pick up additional heat due to windage and thus less parasitic or bleed air is required for cooling purposes.

The foregoing-described construction has additional advantages. For example, the swirl devices 50 can be tuned, i.e., the vanes can be directed at certain angles and aimed at certain defined locations. Because the swirl devices can be bolted or welded in place, the swirl devices are readily modified if fine adjustments in the cooling system are required. It will also be appreciated that the leakage flow past the leakage seal 48 creates a pressure drop between the cavity 38 and the plenum 40. By limiting the leakage flow, the pressure drop can be increased, hence increasing the velocity of the cooling air supplied cavity 38. Increased velocity, of course, results in a cooling air temperature lower than otherwise would be the case with improved performance of the turbomachine.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In turbomachinery having a turbine, a compressor, a component rotatable about an axis and in a cavity, and a fixed component about said rotatable component and said cavity, a cooling system, comprising:

a bleed air passageway for diverting a portion of compressor discharge air for cooling the rotatable component;

a plurality of discrete, generally axially extending passages in communication with said bleed passageway for flowing the bleed air into said cavity; and vanes in said passages for turning the bleed air flowing into said cavity in a generally circumferential direction and in the general direction of rotation of said rotatable component to cool said rotatable component.

2. A cooling system according to claim 1 including a leakage flow path between said passageway and said cavity, a leakage seal between said fixed component and said rotatable component in said leakage flow path causing a pressure drop between said passageway and said cavity to increase the circumferential velocity of the air exiting the vanes into said cavity.

3. A cooling system according to claim 1 wherein said rotatable component comprises a turbine rotor and a compressor rotor, flanges of said turbine rotor and said compressor rotor being joined to one another and being located in said cavity, said vanes turning the bleed air onto and in the direction of rotation of the flanges.

4. A cooling system according to claim 1 wherein said passageway communicates with a plenum, said passages lying in communication with said plenum to flow the bleed air from said plenum and through said vanes.

5. A cooling system according to claim 1 including a leakage flow path between said passageway and said cavity, a leakage seal between said fixed component and said rotatable component in said leakage flow path causing a pressure drop between said passageway and said cavity to increase the circumferential velocity of the air exiting the vanes into said cavity, said rotatable component comprising a turbine rotor and a compressor rotor, flanges of said turbine rotor and said compressor rotor being joined to one another and being located in said cavity, said vanes turning the bleed air onto and in the direction of rotation of the flanges.

6. A cooling system according to claim 5 wherein said passageway communicates with a plenum, said passages lying in communication with said plenum to flow the bleed air from said plenum and through said vanes, said passages being circumferentially spaced from one another about said axis.

7. A cooling system according to claim 1 wherein said rotatable component comprises a turbine rotor and a compressor rotor, flanges of said turbine rotor and said compressor rotor being joined to one another and being located in said cavity, said vanes turning the bleed air onto and in the direction of rotation of the flanges, said passages being circumferentially spaced from one another about said axis, said vanes being disposed at exits of said passages and in said cavity.

* * * * *